United States Patent [19]

Larson et al.

[11] Patent Number: 4,724,000

[45] Date of Patent: Feb. 9, 1988

[54] POWDERED METAL VALVE SEAT INSERT

[75] Inventors: Jay M. Larson; Sundaram L. Narasimhan, both of Marshall; David L. Bonesteel, Richland; John N. Gilmer, Farmington Hills, all of Mich.

[73] Assignee: Eaton Corporation, Cleveland, Ohio

[21] Appl. No.: 924,348

[22] Filed: Oct. 29, 1986

[51] Int. Cl.[4] ..... C22C 29/02

[52] U.S. Cl. ..... 75/236; 75/238; 75/241; 75/243; 75/244; 75/246; 419/11; 419/14; 419/15; 419/13

[58] Field of Search ..... 75/243, 246, 236, 238, 75/241, 244; 419/11, 13, 14, 15

[56] References Cited

U.S. PATENT DOCUMENTS

| | | | |
|---|---|---|---|
| 4,035,159 | 7/1977 | Hashimoto et al. | 419/10 |
| 4,204,031 | 5/1980 | Takemura et al. | 419/11 |
| 4,233,073 | 11/1980 | Takemura | 419/11 |
| 4,377,892 | 3/1983 | Gonzalez | 419/10 |
| 4,485,147 | 11/1984 | Nishino et al. | 419/6 |
| 4,531,273 | 7/1985 | Smith et al. | 419/28 |
| 4,546,737 | 10/1985 | Kazuoka et al. | 75/231 |
| 4,581,202 | 4/1986 | Kudo et al. | 75/246 |

*Primary Examiner*—Stephen J. Lechert, Jr.
*Attorney, Agent, or Firm*—D. A. Rowe; A. E. Chrow

[57] ABSTRACT

Wear resistant articles, especially valve seat inserts for internal combustion engines, are produced as sintered metal compacts comprising interspersed microzones of prealloyed austenitic stainless steel and softer ferrous metal, the microzones of austenitic stainless steel containing carbides and carbonitrides. The sintered compacts can be made by forming a green compact from prealloyed austenitic stainless steel powder atomizate blended with softer powdered ferrous metal component and powdered carbon, and sintering the green compact.

14 Claims, 5 Drawing Figures

POWDERED METAL VALVE SEAT INSERT

TECHNICAL FIELD

This invention relates to engine valves, and more particularly to a new and improved powdered metal valve insert and to a process for making the same.

BACKGROUND ART

A prime requirement for valve seat inserts used in internal combustion engines is wear resistance. In an effort to achieve a combination of good heat and corrosion resistance and machinability coupled with wear resistance, exhaust valve seat inserts have been made as cobalt, nickel or martensitic iron based alloy castings. These alloys have been generally preferred over austenitic heat-resistant steels having high chromium and nickel content because of the presence of wear resistant carbides in the cast alloys.

Powder metallurgy has been adapted to valve seat insert manufacture because the net end shape is achieved more directly than can be done otherwise. It permits latitude to select unique compositions and also offers design flexibility for achieving geometries that permit better air flow compared to other conventional forming methods.

DISCLOSURE OF THE INVENTION

The present invention utilizes the advantages of powder metallurgy in the manufacture of wear resistant items such as valve seat inserts. The invention is particularly characterized by a unique, effective and economic use of heat and wear resistant austenitic stainless steel powder, and the ability to handle such powder in automated part production and to facilitate machinability where needed.

The process provided by the invention comprises forming a green compact from prealloyed austenitic stainless steel powder atomizate blended with a softer powdered ferrous metal component and powdered carbon, and sintering the compact. The ferrous metal component contributes to the green strength of the compact because it is softer and compacts more easily than the austenitic stainless steel powder. It also sinters readily with the austenitic powder and alloys with the carbon by diffusion.

The composition aspect of the present invention is a sintered metal compact, such as a valve seat insert, comprising interspersed microzones of prealloyed austenitic stainless steel and softer ferrous metal, the microzones of austenitic stainless steel containing carbide and carbonitride precipitates The preferred carbon powder is powdered graphite. Where corrosion resistance is a consideration, it can be advantageous to use martensitic stainless steel powder as the softer ferrous metal component. On sintering, the ferrous metal and austenitic steel components form microzones in the sintered compact with the softer ferrous metal enveloping or bridging the austenitic microzones. The austenitic microzones impart corrosion and wear-resistance to the part because of the presence of chromium and its carbides and carbonitrides contained within those zones. The microzones formed by the softer ferrous component provide an oxide that reduces adhesive wear or scuffing during use.

BEST MODE FOR CARRYING OUT THE INVENTION

Figure 1:
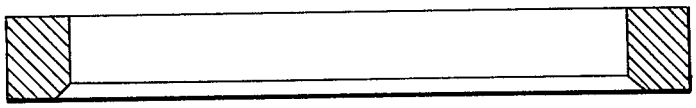
FIGS. 1 and 2 are the elevation and plan views of a valve seat insert for an automobile engine made in accordance with invention principles.
Figure 2:
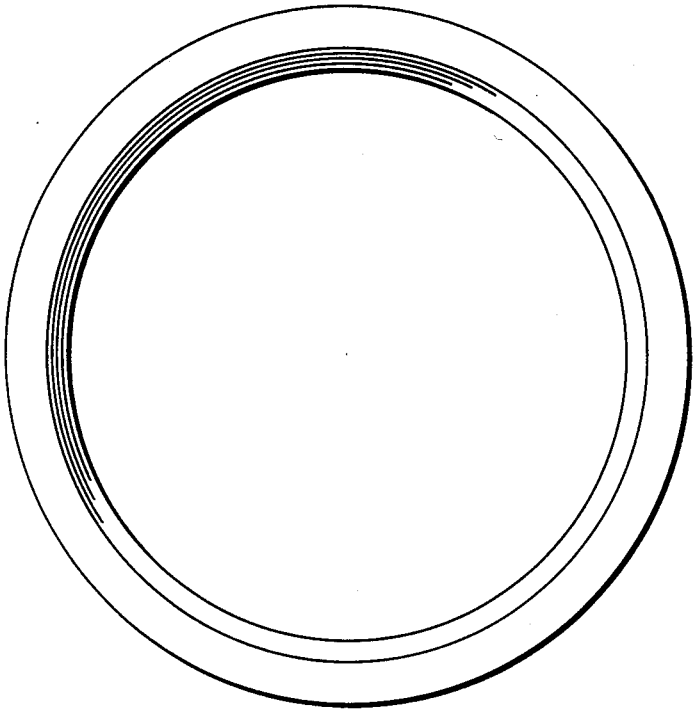

The valve seat insert of FIGS. 1 and 2 typically has about a 1" to 2" inside diameter and is formed as a unitary sintered piece that provides a wear-resistant face. The overall chemical composition of the green compact used for making the insert is essentially as follows:

| | |
|---|---|
| Carbon | 1.0–2.0 |
| Chromium | 9.0–16.5 |
| Molybdenum | 0–2.0 |
| Nickel | 0.5–4.0 |
| Silicon | 0–1.8 |
| Manganese | 0.05–5.0 |
| Copper | 2.0–5.0 |
| Nitrogen | 0–0.50 |
| Phosphorus | 0–0.50 |
| Sulfur | 0–0.50 |
| Iron | Balance |

Figure 3:
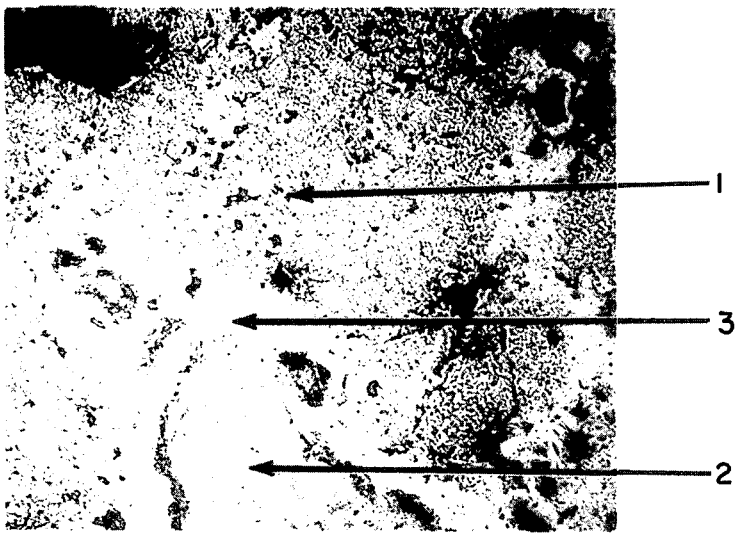
FIGS. 3, 4, and 5 are photomicrographs of etched and polished sintered compact specimens of this invention. They are representative of the products made in Examples 1, 2, and 3, respectively, which follow.

In the FIG. 3 photomicrograph, arrow "1" designates a microzone of austenitic stainless steel containing carbides and carbonitrides and having Rockwell C hardness of 43. Arrow 2 points to a softer ferrous microzone having Rockwell B hardness of 85. The softer ferrous metals appear to envelop or bridge the austenitic microzones. Arrow "3" points to a transition ferrous metal microzone having Rockwell C hardness of 28. Example 1 describes in detail how this kind of sintered compact is made.

Figure 4:
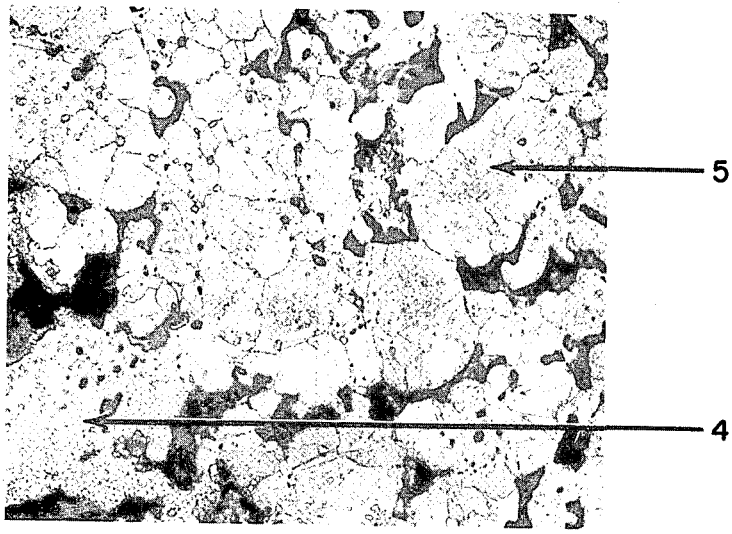

In the FIG. 4 photomicrograph arrow "4" designates a microzone of austenitic stainless steel containing carbides and carbonitrides and having Rockwell C hardness of 50; and arrow "5" designates a microzone of softer ferrous metal having Rockwell C hardness of 30. Example 2 describes in detail how this kind of sintered compact is made.

Figure 5:
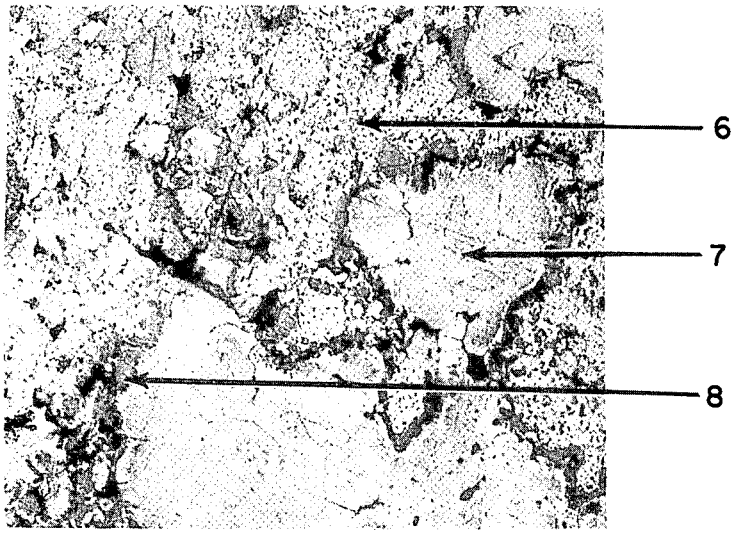

Turning now to the photomicrograph of FIG. 5, arrow "6" designates a microzone of austenitic stainless steel having Rockwell C hardness of 41; arrow "7" designates a microzone of softer ferrous metal having Rockwell B hardness of 84; and arrow "8" points to a transition ferrous metal microzone having Rockwell C hardness of 32 (where it is believed that some martensitic steel material has formed). Example 3 describes in detail how this kind of sintered compact is made.

The green compact is handled and conveyed, usually automatically, to a sintering furnace where sintering of the compact takes place. Sintering is the bonding of adjacent surfaces in the compact by heating the compact below the liquidus temperature of most of the ingredients in the compact.

Soft powdered iron, generally very low in carbon and other elements, can be used in as little as an equal weight proportion or even lower, e.g. 45/55, with the atomized austenitic stainless steel powder to give quite practical green strength. On the other hand, a martensitic stainless steel, for example A.I.S.I. grade 410, is best used in a proportion ranging from about 1.5:1 to about 3:1 with the austenitic material. Green compacts contain broadly between about 25% and about 55% of austenitic stainless steel powder to develop suitable wear and corrosion resistance in applications such as valve seat inserts.

In some instances the atomized austenitic stainless steel powder has been reduction-annealed, e.g., in a reducing atmosphere of dissociated ammonia at temperature of 1850°-2000° F. in order to remove adherence-interfering oxides and soften the powder. However, such operation is not necessary for achieving the performance objectives of this invention.

The powder blend for compacting can have blended with it various other metallic and non-metallic ingredients, normally in fine powder form. Copper powder in an amount up to about 5% by weight of the compact acts apparently as a strengthener, but principally it is used for controlling the size change during sintering and densification of the part. Boron in an amount up to about 0.1% typically added as a ferroboron, can be a sintering aid, but, since it requires high sinter temperature, its use is optional. Phosphorus in an amount up to about 0.50% also is a sintering aid.

Graphite is the main practical way to add carbon to the mass of powder for compacting because sintering ordinarily is done in a fairly short time and there is only limited time at peak temperature for interaction with the ferrous components.

Conventional fugitive lubricants are used in the compacting, generally in a proportion of about 0.5-1.0% based on the combined weight of the other materials. Typical lubricants include zinc stearate, waxes, and proprietary ethylene stearamide compositions which volatilize upon sintering.

The practical maximum amount of each of sulfur, nitrogen and oxygen is about 0.50%. Generally, the powdered stainless steels used may bring to the blend 9-16.5% chromium, 0.5-4% nickel, some of the 0.05-4.0% manganese, possibly some molybdenum, and at least some of the tolerated impurities and carbon along with iron, such percentages being based on the weight of the total blend. Manganese also can be added as a ferroalloy.

Forming the compact customarily is done by pressing the powder at about 40-60 tons per square inch in a die conforming to the part to be made (with allowance for small dimensional change if that is to occur). Sintering preferably is done in about 3 hours at 2100° F. using a hydrogen or dissociated ammonia atmosphere of low dew point (e.g. −28° F. or even lower). The compact is at peak temperature ordinarily for no longer than about 30 minutes. Preferably, the particle size range of the austenitic stainless steel is no more than about 10% being coarser than a 100 mesh sieve and no more than about 50% passing through a 325 mesh sieve (U.S. Standard Sieve Series). The other metal powders usually are in the same general range, sometimes being slightly finer with 55% or more passing a 325 mesh screen. So long as flow properties into the die and its interstices are not adversely affected or the intimacy of blend or the resulting green and sintered strengths are not materially worsened, there is fair latitude in particle size ranges for the powders used.

It is rare in the compacting that a pressure lower than about 35 tons per square inch is useful. Pressures above about 60-65 tons per square inch, while useful, are ordinarily not worth extra expense. Sintering at temperatures below about 1940° F. are quite impractical for developing strength in any reasonable period, and a temperature substantially above about 2250° F. is likely to be difficult to control and leads to furnace degradation. These temperatures are the peak temperatures of the sintering furnace and are maintained as short as possible to develop the sintered strength (25-40 minutes desirable, 30-35 preferred). Furnace temperature, of course, can be platformed in ascending zones as the compacts travel through a furnace continuously. Overall sintering times as low as an hour can be used in some cases, and times much longer than 4 hours lack economy.

Advantageously, the sintered compacts are air cooled, particularly if they are small parts such as valve seat inserts which tend to cool rapidly.

Sometimes it is desirable to further harden the sintered compact by age hardening, e.g. holding such compact at 1000° F. for 8 hours in a dissociated ammonia atmosphere, but this is rarely needed and is considered an expensive expedient for making the preferred valve seat inserts of this invention. Occasionally, however, such heat hardening procedure is useful to produce a part that is especially hard before any work hardening ensues.

The sintered compacts, age-hardened or not, can be finished, typically by grinding, but also by other types of machining, if necessary to reach required tolerances. They can be finished readily by grinding when this is needed. The finished articles, in addition to being formed as valve seat inserts also can be formed as piston rings, sealing rings, gears and other wear-resistant items.

The following examples show ways in which this invention has been practiced, but should not be construed as limiting it. In this specification all percentages are weight percentages, all parts are parts by weight, and all temperatures are in degrees Fahrenheit unless otherwise specially noted. Specifications of the powder compositions referred to in the examples are tabulated as follows:

| Element % | Austenitic Stainless Steel I % | Austenitic Stainless Steel II % | Overall Blend Composition Specification I % | II % | III % |
|---|---|---|---|---|---|
| C | 0.28-0.38 | 0.50-0.60 | 1.0-2.0 | 1.0-2.0 | 1.0-2.0 |
| Cr | 22.00-24.00 | 19.25-21.50 | 9.0-11.0 | 13.5-16.5 | 9.0-12.0 |
| Mo | 0.50 max | 0.50 max. | 0.5 max | 0.35 max | 0.25 max |
| Ni | 7.00-9.00 | 1.50-2.75 | 0.5-1.5 | 0.5-1.0 | 2.0-4.0 |
| Si | 0.60-0.90 | 0.08-0.25 | 0.2 max | 1.0 max | 0.1-1.8 |
| Cu | | | 2.0-5.0 | 0-5.0 | 2.0-5.0 |
| Mn | 1.50-3.50 | 7.00-9.50 | 3.0-5.0 | 2.0-4.0 | 0.05-3.5 |
| P | | | | 0.50 max | 0.50 max |
| N | 0.28-0.35 | 0.20-0.40 | | 0.30 max | |
| S | | | | 0.07 max | 0.09 max |
| Fe | Balance | Balance | Balance | Balance | Balance |
| Sieve Size | +100 mesh 10% max. −325 mesh 50% max. | Same as Stainless Steel I | | | |

In the examples the graphite powder used was Southwestern 1651 grade, a product of Southwestern Industries Inc. The iron powder was Atomet 28 supplied by QMP Corporation, alternatively Hoeganaess 1000B supplied by Hoeganaess Corporation. The copper powder was grade RXH 150 supplied by SCM Corporation.

EXAMPLE 1

Water-atomized austenitic stainless steel powder II was blended with an equal weight of iron powder plus sufficient graphite and copper powders to provide an overall blend having specification I as tabulated.

An ethylene stearamide mold lubricant (Acrawax C, the trademark of Lonza Company) was mixed into the blend (0.75% based on the weight of the unlubricated blend).

The resulting lubricated blend was pressed at 40–42 tons per square inch to form green compacts for making valve seat inserts about 2" in diameter. These green items were sintered for 3 hours in a furnace maintained at 2100° F. (the compacts being at furnace temperature for about ½ hour). Furnace atmosphere was dissociated ammonia having dewpoint of −28° F.

| | |
|---|---|
| Density of green compact, grams per cc. | 6.2 |
| Density of sintered compact, grams per cc. | 6.11 |
| % of theoretical full density, as sintered | 80 |
| As sintered hardness, Rockwell B, apparent | 70 |
| Aged* hardness, Rockwell B, apparent | 90 |
| Ultimate tensile strength, (KSI) | 42–44 |

*Age hardening done by holding the sintered compact at 1000° F. for 8 hours.

This product could be finished, if necessary or desired, by grinding. As produced, however, the valve seat inserts made were suitable for use and displayed good wear-resistance. The austenitic stainless steel surface areas work harden in use.

EXAMPLE 2

Water-atomized austenitic stainless steel powder II (30 parts) was blended with 70 parts of the martensitic (A.I.S.I. grade 410) stainless steel powder of about the same size grading and powdered graphite to provide an overall blend composition II as tabulated. The blend was lubricated like that of Example 1. It then was pressed and sintered like the blend of Example 1. This gave a compact having the following properties:

| | |
|---|---|
| Density of green compact, grams per cc. | 6.2 |
| Density of sintered compact, grams per cc. | 6.14 |
| % of theoretical full density, as sintered | 80 |
| As sintered hardness, Rockwell B, apparent | 70 |
| Aged* hardness, Rockwell B, apparent | 90 |
| Ultimate tensile strength, (KSI) | 39 |

*Age hardening done by holding the sintered compact at 1000° F. for 8 hours.

EXAMPLE 3

Water-atomized austenitic stainless steel powder I was blended with an equal weight of iron powder plus sufficient graphite and copper powders to provide an overall blend having specification III as tabulated.

The blend was lubricated like that of Example 1. It then was pressed and sintered like the blend of Example 1. This gave a compact having the following properties:

The compacting and sintering operation gave material having the following properties:

| | |
|---|---|
| Density of green compact, grams per cc. | 6.3 |
| Density of sintered compact, grams per cc. | 6.1 |
| % of theoretical full density, as sintered | 80 |
| % porosity | 19 |
| Diameter change during sinter | 1.75% |
| As sintered hardness, Rockwell B, apparent | 74 |
| Aged* hardness, Rockwell B, apparent | 25 |

-continued

| | |
|---|---|
| Ultimate tensile strength, thousands of PSI (KSI) | 43 |
| Creep Strain per hr. at 800° F., 12 KSI load | 0.15% |

*Age hardening done by holding the sintered compact at 1000° F. for 8 hours.

Many modifications and variations of the invention will be apparent to those skilled in the art in light of the foregoing disclosure. Therefore, it is to be understood that, within the scope of the appended claims, the invention can be practiced otherwise then as specifically described.

We claim:

1. A process for making a valve seat insert which comprises the steps of:

forming a green compact essentially in the shape of said insert from a blend containing prealloyed austenitic stainless steel powder atomizate, a softer ferrous metal component and powdered carbon; and sintering said compact.

2. The process of claim 1 wherein said green compact contains about 25 to 50% by weight of said austenitic stainless steel powder.

3. The process of claim 1 wherein said carbon is graphite.

4. The process of claim 1 wherein said softer ferrous metal component is martensitic stainless steel powder.

5. The process of claim 1 wherein the overall chemical composition of the green compact is essentially as follows:

| | % |
|---|---|
| Carbon | 1.0–2.0 |
| Chromium | 9.0–16.5 |
| Molybdenum | 0–2.0 |
| Nickel | 0.5–4.0 |
| Silicon | 0–1.8 |
| Manganese | 0.05–5.0 |
| Copper | 0–5.0 |
| Nitrogen | 0–0.50 |
| Phosphorus | 0–0.50 |
| Sulfur | 0–0.50 |
| Iron | Balance |

6. The process of claim 1 wherein the overall chemical composition of the green compact is essentially as follows:

| | % |
|---|---|
| Carbon | 1.0–2.0 |
| Chromium | 9.0–11.0 |
| Molybdenum | 0–2.0 |
| Nickel | 0.5–1.5 |
| Silicon | 0–0.2 |
| Manganese | 3.0–5.0 |
| Copper | 2.0–5.0 |
| Iron | Balance |

7. The process of claim 1 wherein the sintered compact is age-hardened.

8. A process for making a sintered metal compact which consists essentially of forming a green compact from a blend comprising prealloyed austenitic stainless steel powder atomizate and a softer ferrous metal component and powdered carbon, and sintering said compact.

9. A powdered metal valve seat insert comprising interspersed microzones of prealloyed austenitic stainless steel and softer ferrous metal in a sintered compact, said microzones of austenitic stainless steel containing carbides and carbonitrides, and said insert made by a process comprising the steps of:

forming a green compact essentially in the shape of said insert from a blend containing prealloyed austenitic stainless steel powder atomizate, a softer ferrous metal component and powdered carbon; and sintering said compact.

10. The compact of claim 9 wherein said softer ferrous metal component comprises martensitic stainless steel.

11. The compact of claim 9 wherein the weight proportion of austentic stainless steel is between about 25 and about 50%.

12. The compact of claim 9 which contains about 0–5% copper, up to 2.0% molybdenum, and about 0.05–5% manganese.

13. The compact of claim 9 which has been age-hardened.

14. A sintered metal compact comprising interspersed microzones of prealloyed austenitic stainless steel and softer ferrous metal, said microzones of austenitic stainless steel containing carbonides and carbonitrides, and said compact made by a process comprising the steps of:

forming a green compact essentially in the shape of said sintered compact from a blend containing prealloyed austenitic stainless steel powder atomizate, a softer ferrous metal component and powdered carbon; and sintering said green compact.

* * * * *